United States Patent [19]

Papworth

[11] 4,068,483

[45] Jan. 17, 1978

[54] PROTECTIVE SHEATH FOR WATER-ERODED WOOD PILING

[76] Inventor: Charles A. Papworth, 1018 SW. 21st St., Fort Lauderdale, Fla. 33315

[21] Appl. No.: 753,288

[22] Filed: Dec. 22, 1976

[51] Int. Cl.[2] ..... E02D 5/60

[52] U.S. Cl. ..... 61/54; 264/32; 264/36

[58] Field of Search ..... 61/54, 63; 52/744, 743; 264/32, 36

[56] References Cited

U.S. PATENT DOCUMENTS

| | | | |
|---|---|---|---|
| 1,512,660 | 10/1924 | Wright et al. | 61/54 X |
| 2,128,336 | 8/1938 | Torstensson | 52/744 X |
| 3,338,058 | 8/1967 | Young | 61/54 |
| 3,397,260 | 8/1968 | Lamberton | 264/36 X |
| 3,858,839 | 1/1975 | Bowman | 264/36 X |

*Primary Examiner*—Dennis L. Taylor

*Attorney, Agent, or Firm*—Oltman and Flynn

[57] ABSTRACT

The present sheath for a water-eroded wood piling is a longitudinally split, flexible and resilient plastic casing with overlapping circumferential end segments. The casing has a preformed, integral spout at its upper end into which wet concrete can be poured to fill the casing around the eroded section of the piling. Flexible bands clamp the casing tightly around the piling, and the spout has aligned openings in its opposite sides for passing the uppermost one of these bands. The casing may comprise two or more longitudinal sections in overlapped sealed engagement with each other end-to-end for enclosing a long eroded section of the piling.

4 Claims, 9 Drawing Figures

PROTECTIVE SHEATH FOR WATER-ERODED WOOD PILING

BACKGROUND OF THE INVENTION

Various arrangements have been proposed heretofore for protecting wood pilings which extend down into a body of water and are subject to erosion by the water.

Examples of such prior piling protectors are disclosed in the following U.S. patents: Shaw et al U.S. Pat. No. 3,719,049; Liddell U.S. Pat. Nos. 3,027,610 and 3,141,301; Derby U.S. Pat. No. 2,470,149; Lamberton U.S. Pat. No. 3,708,146; and Lane U.S. Pat. No. 2,385,869.

In the above-cited Derby, Lamberton and Lane patents a sleeve-like sheath is placed around the piling and then is filled with concrete or other suitable material. In the Shaw et al patent such a sheath is filled with a rust inhibitor, whereas in the Liddell patents stagnant water trapped inside the sheath is relied on to inhibit further erosion of the piling.

SUMMARY OF THE INVENTION

The present invention is directed to a novel and improved piling protector in the form of a longitudinally split casing having a preformed, outwardly-offset spout at its upper end which facilitates the pouring of concrete down into the casing after it has been applied to a water-eroded piling. The lower end of the spout reaches the eroded area of the piling, and the concrete poured into the spout fills in the eroded area of the piling inside the casing. The casing may be clamped tightly around the piling by suitable flexible bands, the uppermost one of which passes through aligned openings in the opposite sides of the spout.

Where necessary, the present casing may be of sectional construction, with two or more longitudinal sections arranged end-to-end in overlapped, sealed relationship to completely cover a relatively long eroded section of the piling.

The present casing is of water-resistant plastic and has overlapped, opposite circumferential end segments which can be spread apart when the casing is being applied to the piling and then spring back into overlapped relationship once the casing is on.

A principal object of this invention is to provide a novel and improved protective sheath which may be readily applied to a water-eroded piling and has an integral spout at its upper end which facilitates the pouring of concrete down into the eroded area of the piling after the sheath is in place on the piling.

Another object of this invention is to provide such a protective sheath which may comprise two or more longitudinal sections which are overlapped and sealed to each other end-to-end to enclose an eroded section of substantial vertical depth on a piling.

Further objects and advantages of this invention will be apparent from the following detailed description of certain presently-preferred embodiments thereof, shown in the accompanying drawings in which.

Figure 1:
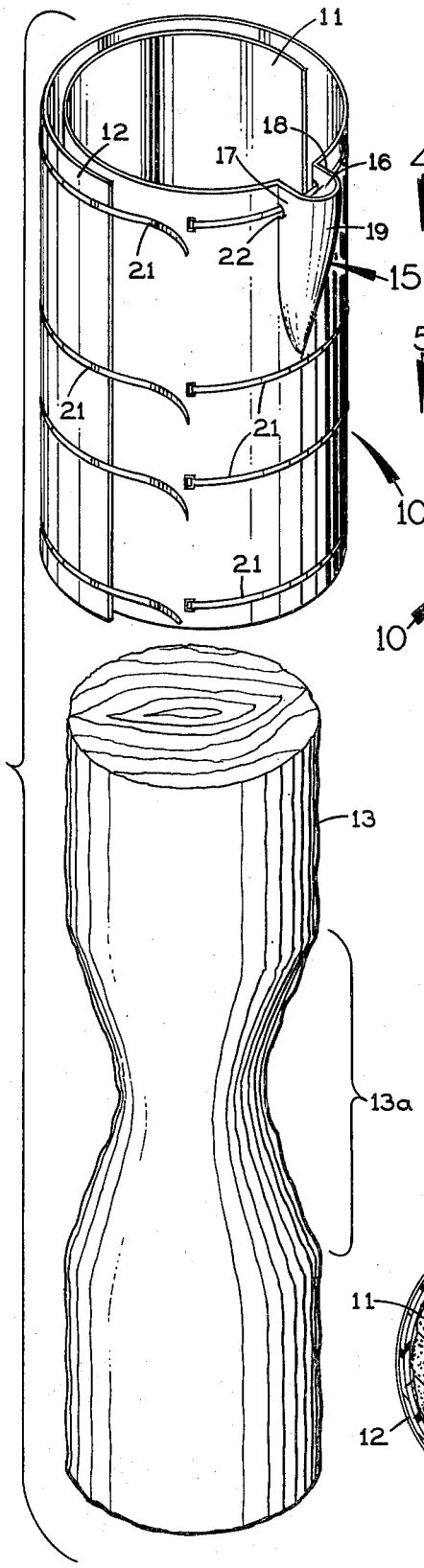
FIG. 1 is an exploded perspective view of an eroded wood piling and a one-piece protective sheath for the piling in accordance with the present invention.
Figure 2:
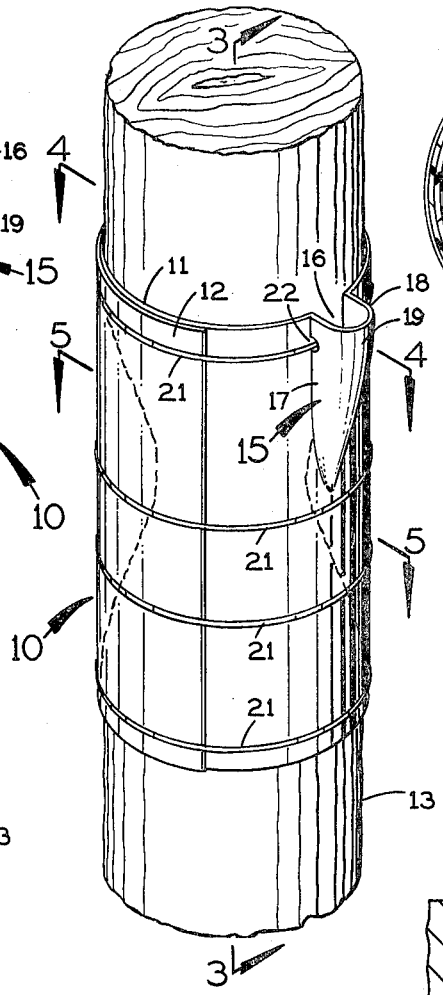
FIG. 2 is a perspective view showing this sheath applied to the piling.

Referring first to FIGS. 1 and 2, the protective sheath of the present invention is an elongated, longitudinally split, generally cylindrical casing 10 of suitable water-resistant plastic material, such as polyvinyl chloride. In one practical embodiment this casing is of integral, one-piece construction with a length of 48 inches. In its normal unstressed condition the casing has its opposite circumferential end segments 11 and 12 overlapped through a circumferential extent of about 180 degrees, with the arcuate outer end segment 12 extending fairly closely around the outside of the arcuate inner end segment 11.

The casing is sufficiently flexible and resilient that its normally overlapping circumferential end segments 11 and 12 can be spread apart or separated to enable the casing to be applied from the side to a wood piling 13 extending down into the water and having a water-eroded area **13*a* (FIG. 1) in the vicinity of the water line. The resiliency of the casing causes its circumferential end segments 11 and 12 to spring back into overlapped relationship once the casing is on the piling, so that the casing snugly encircles the piling above and below the eroded area, as best seen in FIG. 2**. The casing may be applied to a piling whose uneroded diameter is greater or slightly less than the inside diameter of the casing in its unstressed condition.

Figure 3:
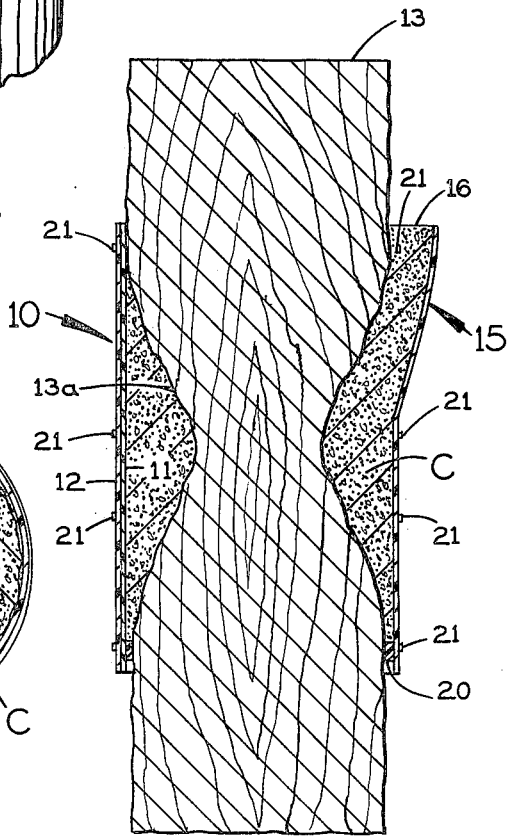
FIG. 3 is a vertical section taken along the line 3—3 in FIG. 2.

In accordance with the present invention, the casing 10 has an integral preformed spout 15 at its upper end, located about midway between its overlapping circumferential end segments 11 and 12 and projecting laterally outward from the generally cylindrical body of the casing to provide a pour opening 16 at the top. The spout has generally radially disposed opposite sides 17 and 18 which are connected by a rounded outer end 19. The spout has an appreciable vertical extent along the casing so that it provides a passageway that opens directly into the upper end of the space between the casing and the eroded area of the piling once the casing has been properly positioned on the piling, as shown in FIG. 3.

Figure 4:
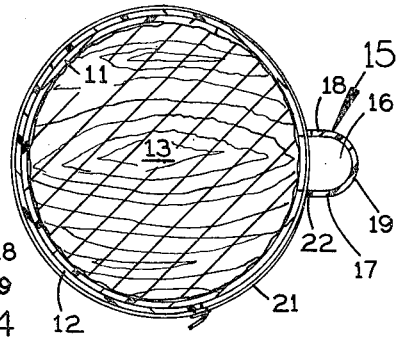
FIG. 4 is a horizontal cross-section taken along the line 4—4 in FIG. 2 near the upper end of the protective sheath.

In the use of this casing, a strip 20 (FIG. 3) of foam rubber, polyurethane foam or other suitable material is engaged between the piling and the inside of the casing near the bottom, below the eroded area of the piling. Several flexible straps 21 of stainless steel are wrapped tightly around the outside of the casing at intervals along its length to clamp it tightly around the casing. The uppermost strap passes through aligned openings 22 (FIG. 4) formed in the opposite sides 17 and 18 of the spout 15.

Figure 5:
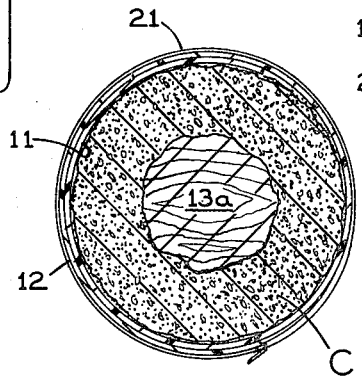
FIG. 5 is a horizontal cross-section taken along the line 5—5 in FIG. 2 midway along the sheath.
Figure 6:
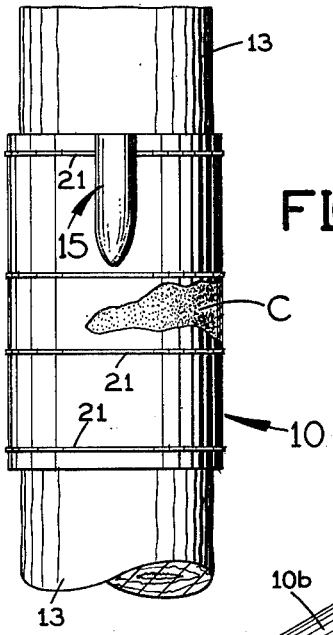
FIG. 6 is an elevational view of the sheath on the piling, partly broken away to reveal the concrete filling the inside of the sheath around the eroded section of the piling.

With the casing clamped tightly around the piling and its lower end sealed by the foam strip 20, concrete is poured down into the spout 15 and flows down into the interior of the casing 10 to fill the space between the inside of the casing and the eroded area of the piling and provide a structural reinforcement for the latter. This concrete filling is shown at C in FIGS. 3, 5 and 6.

Preferably, the casing 10 is left on the piling to protect it against further erosion by the water. However, if desired, the casing may be removed from the piling after the concrete has hardened, leaving the concrete as the sole protection against such erosion.

Figure 7:
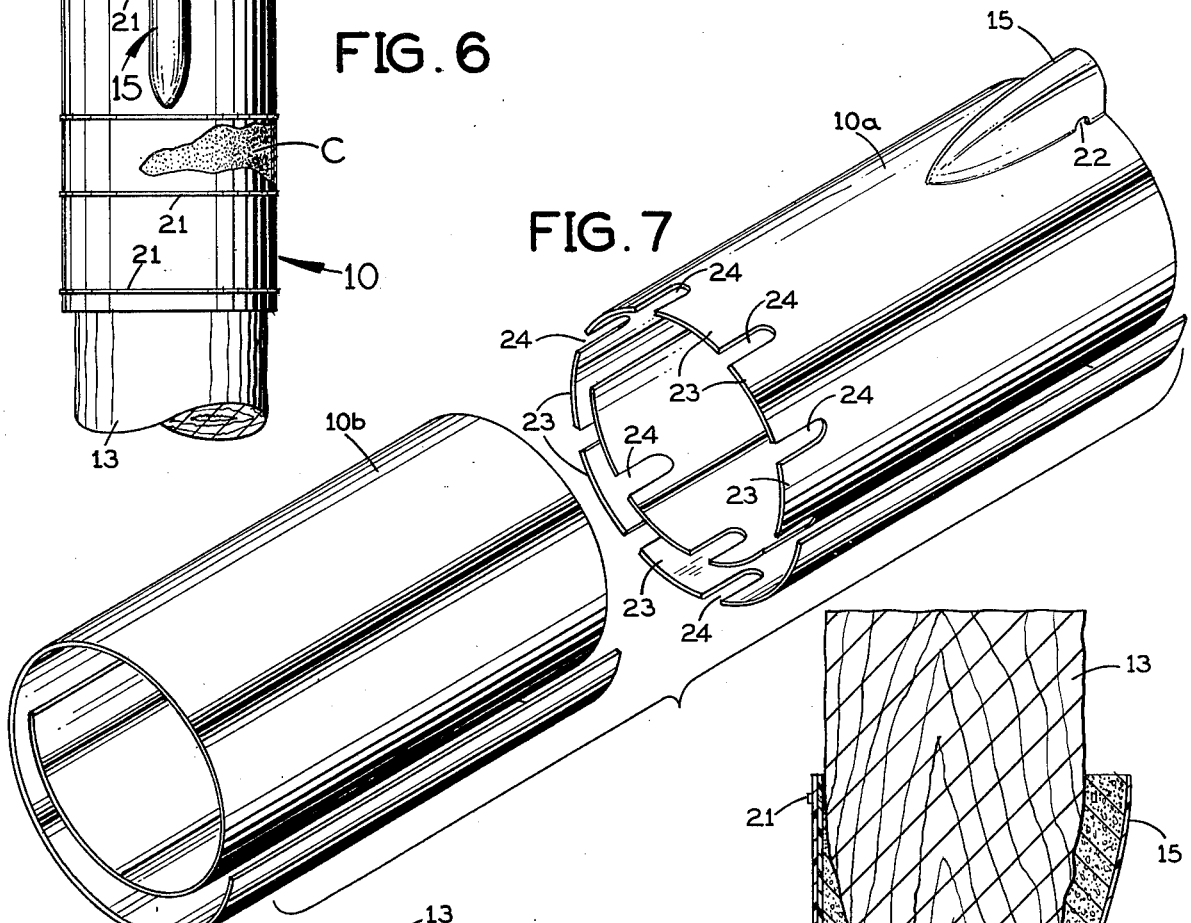
FIG. 7 is an exploded perspective view of a two-piece sheath in accordance with the present invention.
Figure 8:
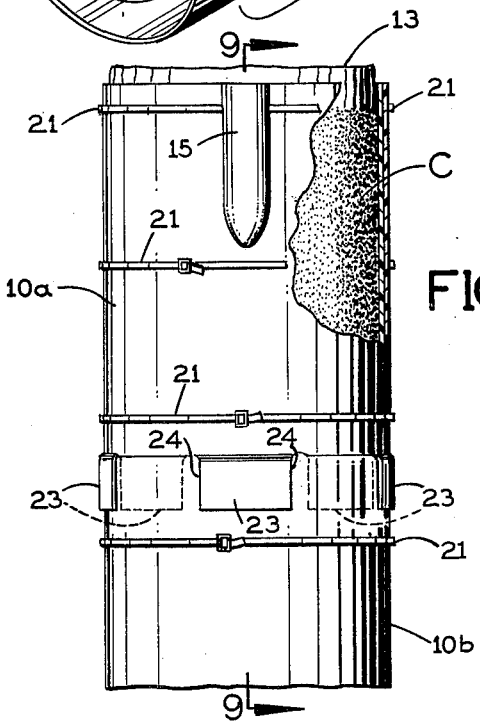
FIG. 8 is an elevational view of this two-piece sheath on a piling, partly broken away to show the concrete filling.
Figure 9:
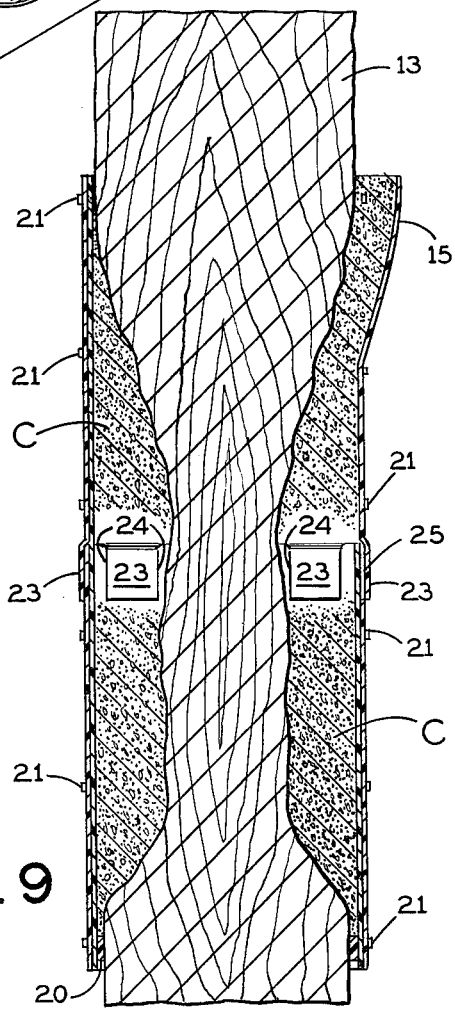
FIG. 9 is a vertical section taken along the line 9—9 in FIG. 8.

Also, if desired, a protective fill other than concrete might be poured into the present casing to inhibit erosion of the piling.

Where the piling is eroded for a relatively long extent vertically, the present casing may consist of two or more longitudinal sections connected end-to-end and sealed to each other to provide a continuous casing, as shown in FIGS. 8 and 9. In this embodiment, as best seen in FIG. 7, the upper section 10*a* of the casing has downwardly projecting, arcuate end flaps 23 on its lower end which are separated by longitudinal slits 24. Alternate end flaps 23 on the upper section are respectively positioned inside and outside the next lower section 10*b* as shown in FIG. 8, and a suitable water-resistant adhesive is applied at 25 (FIG. 9) between these end flaps and the adjacent portions of the lower section 10*b* so that the two casing sections now are adhesively attached permanently to each other.

In this sectional casing, the pour spout 15 is provided only on the upper section 10*a*. The lower section 10*b* is substantially cylindrical (with overlapped opposite circumferential end segments) throughout its extent, as best seen in FIG. 7.

With this arrangement the different sections of the casing may be small enough in length that they can be easily applied to the piling individually and then connected end-to-end in longitudinally overlapped, adhesively sealed engagement, as shown and described. If desired, the sectional casing may comprise three or more longitudinal sections overlapped and sealed to one another end-to-end as shown and described for the two-piece sectional casing of FIGS. 7–9.

I claim:

1. In a protective sheath for attachment to an upstanding wood piling in place in a body of water and having a water-eroded area in the vicinity of the water line, said protective sheath comprising a preformed, longitudinally split casing of water-resistant plastic material having a length greater than the height of the eroded area of the piling for circumferentially enclosing the latter, said casing having overlapping opposite circumferential end segments disconnected from each other along the entire length of the casing and arranged with one circumferentially overlapping the other on the outside, said end segments of the casing being sufficiently flexible to be spread apart to enable the casing to be expanded radially and applied around the piling and being sufficiently resilient to spring back into said overlapping relationship after the casing has been applied around the piling, and means for clamping said casing directly to the piling above and below the eroded area, the improvement wherein said casing has a preformed integral, outwardly offset spout at its upper end spaced circumferentially from said overlapping end segments and providing at the top of the casing a pour opening for concrete or the like, said spout extending down along the casing a distance sufficient to reach the eroded area of the piling to which the casing is applied.

2. A protective sheath according to claim 1, wherein said means for clamping comprises flexible straps at different locations along the length of the casing, and said spout has circumferentially spaced, opposite sides with aligned openings therein for passing the uppermost strap to clamp the upper end of the casing tightly around the piling.

3. A protective sheath according to claim 1, wherein said casing has two or more longitudinal sections thereof spliced end-to-end in longitudinally-overlapped, sealed engagement with each other, and at said spliced engagement one of the longitudinal sections of the casing has a plurality of circumferentially spaced end flaps which are alternately disposed contiguously outside and inside the adjacent end of the adjoining longitudinal section of the casing and adhesively bonded to the latter.

4. A protective sheath according to claim 2, wherein said casing has two or more longitudinal sections thereof spliced end-to-end in longitudinally-overlapped, sealed engagement with each other, and at said spliced engagement one of the longitudinal sections of the casing has a plurality of circumferentially spaced end flaps which are alternately disposed contiguously outside and inside the adjacent end of the adjoining longitudinal section of the casing and adhesively bonded to the latter.

* * * * *